US005334001A

United States Patent [19]

Williams

[11] Patent Number: 5,334,001

[45] Date of Patent: Aug. 2, 1994

[54] MOUNTING ARRANGEMENT FOR A POSITIVE DISPLACEMENT SLURRY PUMP

[75] Inventor: Richard L. Williams, Harrod, Ohio

[73] Assignee: The Williams Pump Co., Harrod, Ohio

[21] Appl. No.: 97,951

[22] Filed: Jul. 27, 1993

Related U.S. Application Data

[63] Continuation-in-part of Ser. No. 20,109, Feb. 19, 1993, abandoned, which is a continuation of Ser. No. 749,875, Aug. 26, 1991, abandoned.

[51] Int. Cl.[5] ..... F04B 35/00

[52] U.S. Cl. ..... 417/360; 417/361; 417/568; 417/565; 417/900

[58] Field of Search ..... 417/360, 361, 415, 454, 417/567, 568, 900, 565; 92/128, 170.1, 161

[56] References Cited

U.S. PATENT DOCUMENTS

| | | | |
|---|---|---|---|
| 2,811,929 | 11/1957 | Rupp | 417/565 |
| 3,496,874 | 2/1970 | Findlay | 417/565 |
| 3,871,795 | 3/1975 | Habdo et al. | 417/360 |
| 4,097,962 | 7/1978 | Alley et al. | 417/360 |
| 4,258,612 | 3/1981 | Kuhlmann | 92/128 |
| 4,527,961 | 7/1985 | Redwine et al. | 417/454 |
| 4,869,655 | 9/1989 | Powers et al. | 417/361 |
| 4,948,351 | 8/1990 | Williams | 417/565 |
| 4,971,526 | 11/1990 | Ruyle | 417/360 |
| 5,228,842 | 7/1993 | Guebeli et al. | 417/360 |

FOREIGN PATENT DOCUMENTS

| | | | |
|---|---|---|---|
| 875141 | 7/1949 | Fed. Rep. of Germany | 417/454 |
| 386432 | 1/1933 | United Kingdom | 417/360 |
| 2167501 | 5/1986 | United Kingdom | 417/454 |

*Primary Examiner*—Richard A. Bertsch
*Assistant Examiner*—Roland G. McAndrews
*Attorney, Agent, or Firm*—Jacox & Meckstroth

[57] ABSTRACT

A positive displacement pump includes a vertical pump cylinder or body formed from an extruded tube or pipe of rigid plastics material, and the pump body has a lower end portion connected by an annular compression coupling and a set of bolts to a mating portion of a pump base supported by a fabricated tubular frame. The pump base includes a smaller horizontal conduit having opposite ends removably connected to a set of flapper-type check valves. The upper end portion of the pump body is connected to a support flange by a set of tie rods extending from the coupling and pump base, and a piston is moved axially within the pump body by an offset connecting rod and an eccentric drive mounted on the output shaft of a motor-reducer drive unit. The drive unit is mounted on a platform which rests on the support flange and is pivotally supported by the frame. The platform and drive unit are tilted to an inclined position by a hydraulic jack extending between the platform and frame to provide for convenient access and rapid servicing of the pump body and sealing rings surrounding the piston.

8 Claims, 3 Drawing Sheets

MOUNTING ARRANGEMENT FOR A POSITIVE DISPLACEMENT SLURRY PUMP

RELATED APPLICATIONS

This application is a continuation-in-part of application Ser. No. 08/020,109, filed Feb. 19, 1993, now abandoned, which is a continuation of application Ser. No. 07/749,875, filed Aug. 26, 1991, now abandoned.

BACKGROUND OF THE INVENTION

The present invention relates to a positive displacement pump of the general type disclosed in U.S. Pat. No. 4,948,351 which issued to the inventor of the present invention. This type of pump is particularly suited for handling sewage and other liquids which contain large solids and/or grit and abrasive materials or highly viscous materials, such as commonly encountered in residential sewage systems, waste water treatment plants and some industrial plants. As disclosed in the above patent, the positive displacement pump includes a base formed by a horizontal cylindrical conduit having opposite ends connected to flapper-type check valves. A vertical pump cylinder or housing is connected to the conduit and receives a piston which is reciprocated by a connecting rod extending from a crank arm driven by a motor gear reducer unit mounted on the housing.

When using such a pump, it has been found desirable for the pump to provide for an extended period of service without maintenance and for minimizing the time required for servicing the pump when maintenance is required. It is also desirable for the pump to be designed and constructed to prevent jamming of the reciprocating movement of the piston and to provide for a straight flow through conduit and for operating the pump at a relatively slow speed in order to extend the operating life of the pump components. It is further desirable to minimize the cost of the pump components which must be replaced after an extended period of pump operation in order to minimize the cost of servicing.

SUMMARY OF THE INVENTION

The present invention is directed to an improved positive displacement pump which provides all of the desirable features mentioned above, including an extended pump operating life and for convenient servicing with the replacement of parts in a substantially shorter period of time and without the need of special tools or equipment. The pump of the invention is also adapted to be made in different sizes and pumps liquids containing large solids and/or abrasive or corrosive materials or highly viscous fluids.

In accordance with a preferred embodiment of the invention, a pump cylinder or body is formed from an extruded tube or pipe of rigid plastics material and has a lower end portion connected to a mating cylindrical part of a fabricated steel pump base by annular compression flanges and a series of bolts. The pump base includes a smaller diameter horizontal conduit having opposite ends removably connected to a set of flapper-type check valves, and the pump base is supported by a fabricated tubular frame. A support flange is mounted on the upper end of the pump body and is connected to the compression flanges by a set of peripherally spaced tie rods. A fabricated tubular platform rests upon the support flange and supports a motor-gear reducer drive unit having an output shaft connected by an eccentric drive and an offset connecting rod to a cup-shaped piston supported within the pump body for vertical movement.

The piston carries a pair of resilient sealing rings which are spaced axially by a distance greater than the stroke of the piston and which slidably engage the inner smooth surface of the pump cylinder or body. A hydraulic jack extends between the frame and the platform and provides for conveniently tilting the platform and the drive unit to an inclined retracted position to simplify removal and replacement of the pump body and resilient seals after the tie rods and coupling flanges are disconnected.

Other features and advantages of the invention will be apparent from the following description, the accompanying drawings and the appended claims.

DESCRIPTION OF THE PREFERRED EMBODIMENTS

Figure 1:
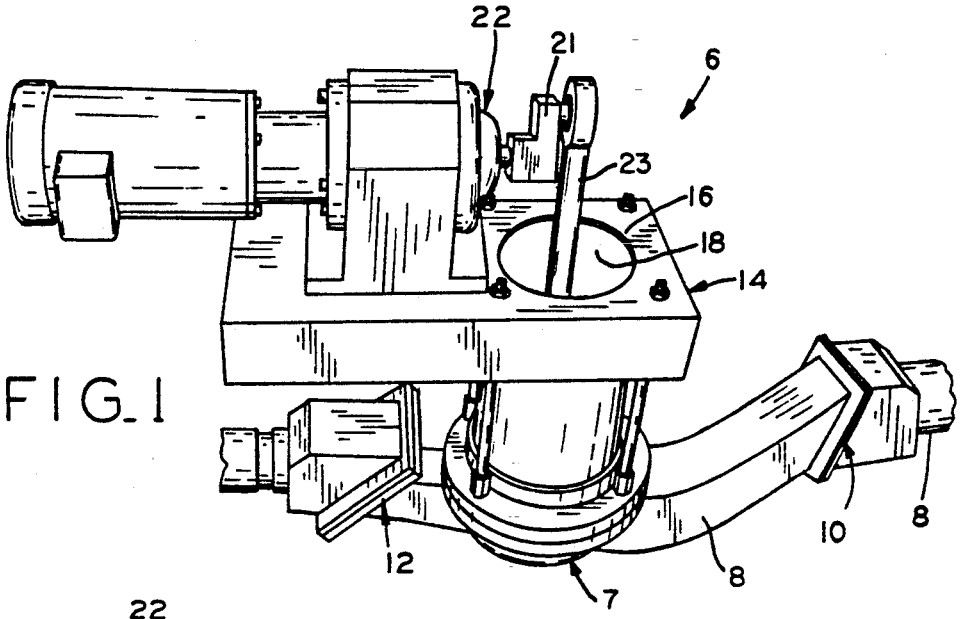
FIG. 1 is a perspective view of a positive displacement pump constructed in accordance with one embodiment of the invention.

FIG. 1 illustrates a positive displacement sewage pump 6 which incorporates a base portion 7 including a conduit 8, a set of check valves 10 and 12, and a platform 14. The conduit 8 is of conventional construction, and the check valves 10 and 12 may be similar to those disclosed in above mentioned U.S. Pat. No. 4,948,351. The pump 6 includes a cylindrical pump housing or body 16 having a smooth inner cylindrical surface 18 and preferably constructed from an extruded tube of rigid plastics material. One form of rigid plastics material which has provided satisfactory results is a rigid polyvinylchloride (PVC) material which is slightly higher in density than the PVC material used to extrude plastic sewage tubing or pipe, for example, the type SDR 21-200 psi material manufactured by CertainTeed Corporation.

Figure 3:
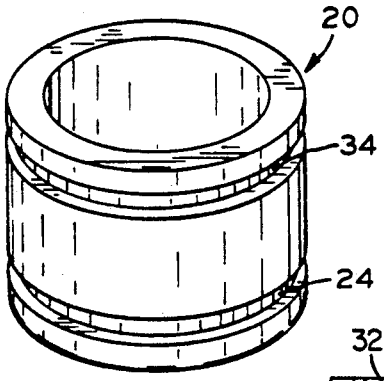
FIG. 3 is a perspective view of the piston shown in FIG. 2.
Figure 5:
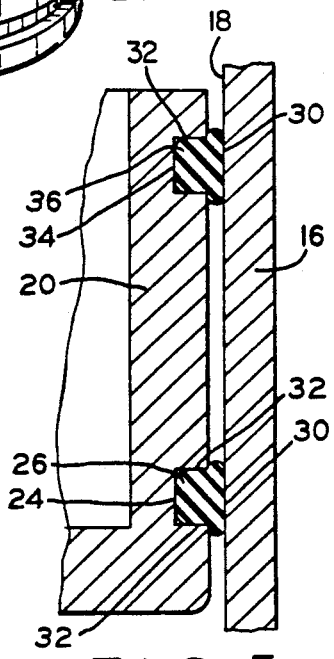
FIG. 5 is an enlarged fragmentary section of the piston and sealing rings engaging the pump body, as also shown in FIG. 2.

A cup-shaped piston 20 is disposed within the body 16 and is connected to a motor-gear reducer drive unit 22 by a crank arm 21 and connecting rod 23. Referring to FIGS. 3 and 5, an annular groove 24 is located near the bottom of the piston 20 and receives a resilient sealing ring 26 for contacting the smooth inner surface 18 of the pump body 16. The diameter of the piston 20 is slightly smaller than the diameter of the surface 18 (FIG. 5) so that the sealing ring 26 is compressed and forms a cylindrical surface 30 for slidably engaging the wall surface 18. The ring 26 slides on the surface 18 and is prevented from rolling within the groove 24 by the positive engagement with radial surfaces or shoulders 32 defining the groove 24. The smooth sliding contact between the ring 26 and the inner surface 18 provides for relatively frictionless movement of the ring while maintaining a positive fluid-tight seal. The sealing ring 26 is formed from a length of extruded material which is heated at its ends and fused together.

The piston 20 shown in FIGS. 3 and 5 also includes an upper annular groove 34 which receives a second resilient ring 36. The ring 36 is constructed the same as the sealing ring 26 and also has an outer cylindrical surface 30 for slidably engaging the inner surface 18 of the body 16. The two sealing rings 26 and 36 help to minimize blow-by and achieve a reliable seal between the piston and cylinder body 16. The axially spaced rings 26 and 36 also aid in centering the piston within the body 16 and in guiding the piston 20 axially in order to minimize wear on the resilient rings and the inner surface 18. A lubricating material may be placed or injected into the space between the rings 26 and 36, if desired. The rings 26 and 36 are installed on the piston 20 by placing them over the piston and sliding them into the grooves 24 and 34 where the rings are positively confined and prevented from rolling by the radial shoulders 32. Preferably, both of the resilient rings 26 and 36 are made from extruded polyurethane having a hardness within the range of 70 to 90 durometer. The sealing rings 26 and 36 are compressed between the piston 20 and the inner surface 18 within a range of about 10 to 25%, and preferably about 20%.

Figure 2:
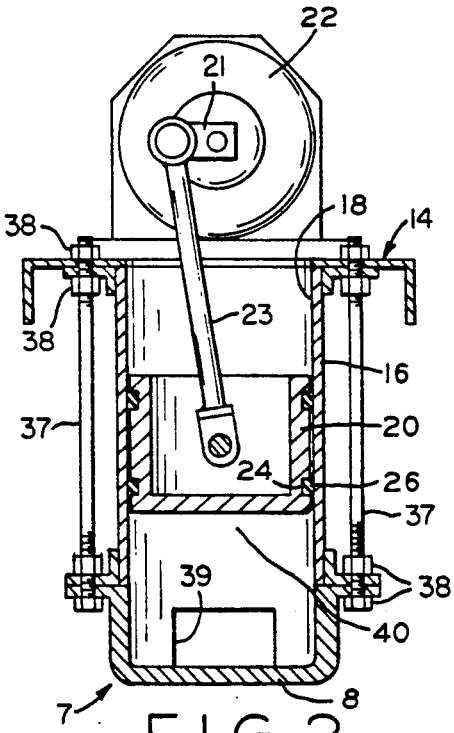
FIG. 2 is a partial cross-sectional view of the pump shown in FIG. 1.

As shown in FIG. 2, the drive unit 22 is mounted on the platform 14 which is supported by the base 7 and conduit 8 by a set of four tie rods 37 secured to the base 7 and platform 14 by a set of threaded nuts 38.

In operation of the pump 6, when the piston 20 is reciprocated within the pump body 16 by rotation of the crank 21, the liquid is pulled or sucked through the check valve 10 and the inlet 39 (FIG. 2) and into the chamber 40 during upward movement of the piston 20. The liquid is forced outwardly through the check valve 12 during downward movement of the piston 20 until the bottom of the piston reaches the bottom of its stroke which is flush with the top of the inlet 38.

Referring to FIGS. 6–11 which show a positive displacement pump 50 constructed in accordance with another embodiment of the invention, a cylindrical pump housing or body 52 is formed from an extrusion of rigid plastics material such as the rigid polyvinylchloride mentioned above, and has an inner diameter, for example, of about 10 inches. The pump body 52 defines a cylindrical pump chamber 54 and has a lower end portion 56 (FIG. 10) which telescopes into a cylindrical metal casing 58 forming part of a fabricated pump base 60. The base 60 also includes a tubular or cylindrical conduit 62 which is formed from steel tubing and is substantially smaller in diameter than the pump body 52 to define a cylindrical chamber 64. The bottom of the casing 58 is connected to the conduit 62 by a pair of opposing part-conical walls 66 which are welded to the casing and the conduit. An annular flange 72 (FIG. 6) is welded to the cylindrical casing 58 and mates with an annular compression flange 74 which slides over the pump body 52 and has an inner annular cavity for receiving a resilient sealing ring 76. The flanges 72 and 74 and ring 76 form a compression coupling and are compressed together by a series of peripherally spaced bolts 79 (FIG. 11) which extend upwardly through corresponding aligned holes within the flanges and are threaded into tubular nuts 82 located on top of the flange 74. When the flanges 72 and 74 are compressed together, the resilient ring 76 forms a positive fluid-tight seal between the pump body 52 and the cylindrical casing 58 of the pump base 60.

The opposite ends of the horizontal tubular conduit 62 are welded to corresponding annular flanges 86 (FIG. 6), and a pair of one way flapper-type check valves 88 are removably secured to the flanges 86 by corresponding sets of bolts 91. The check valves 88 are commercially available from different sources, and one form of check valves which has provided satisfactory results is sold under the trademark VAL-MATIC. Each check valve 88 has a straight flow through passage and includes a molded rubber flap-type valve member 94 which is retained by a removable cap 96 and extends in its closed position at an angle of about 45° relative to the axis of the conduit 62. The valve member 94 of each check valve 88 pivots or flexes clockwise through an angle of about 35° to an open position and is reinforced by a metal insert plate 98.

The pump 50 also includes a frame 105 which is fabricated from square steel tubing, and the frame includes a rectangular base portion formed by tubular members 107 welded at the corners and connected by a pair of angle cross supports 109. The supports 109 have part-circular recesses 111 (FIG. 10) for receiving and supporting the flanges 86 of the pump base 60, and the supports 109 are welded to the flanges 86.

The cylindrical pump housing 52 has an upper end portion with a peripheral shoulder 116 (FIG. 11) which receives an annular support member or flange 118. A series of four elongated tie rods 122 are spaced uniformly around the pump body 52 and have lower end portions threaded into the tubular nuts 82. The rods 122 have upper end portions which extend through corresponding holes within the flange 118 for receiving corresponding nuts 124. When the nuts 124 are tightened, the tubular pump body 52 is compressed axially to secure the pump body to the casing 58. A set of lock nuts 127 are located under the flange 118 are tightened so that any load on the flange 118 is carried by the tie rods 122, the base 60 and frame 105.

Figure 9:
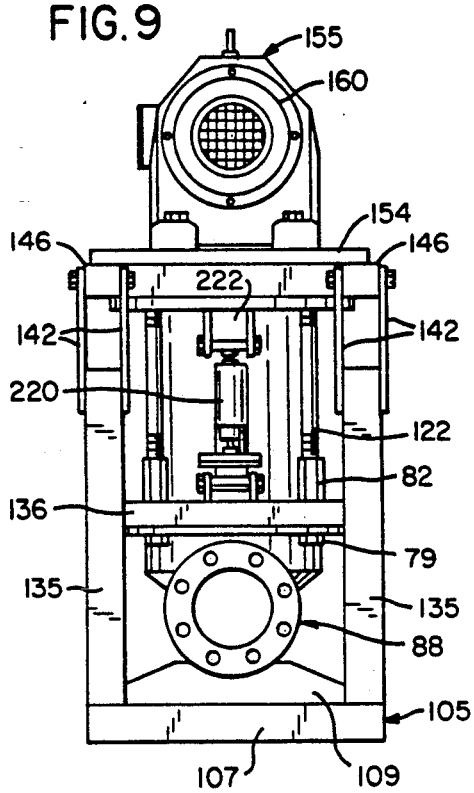
FIG. 9 is an elevational end view taken generally on the line 9—9 of FIG. 6.

Referring again to FIG. 6, the frame 105 includes a pair of upright tubular corner posts 135 which are rigidly connected by an inverted U-shaped frame member 136 and a pair of frame arms 137 (FIG. 9). Two pairs of hinge plates 142 are welded to the upper end portions of the corner posts 135 and project upwardly. A platform 145 (FIG. 6) is also fabricated of square steel tubing and includes parallel spaced tube members 146 (FIG. 7) rigidly connected by a set of three tubular cross members 148 (FIG. 6) having ends welded to the members 146. The right end portions (FIG. 6 and 7) of the platform members 146 are pivotally connected to the hinge plates by a set of hinge pins or bolts 152.

A cross plate 154 (FIG. 6) is welded to the platform members 146 and 148 and supports a drive unit 155 including a gear box 158 driven by a flange-mounted electric motor 160 which may be a variable speed motor. The gear box 158 has an output shaft 162 which rotates at a relatively low speed, for example, on the order of 20 to 30 rpm. A series of bolts 164 secure the drive unit 155 to the support plate 154, and the platform 145 normally rests on the upper flange 118 which is supported from the base 60 and frame 105 by the tie rods 122.

A drive block 166 (FIG. 6) has a bore which receives the shaft 162 and is positively secured to the shaft for rotation with the shaft. The block 166 has another bore 168 which receives the outer race of an anti-friction spherical bearing 172. An eccentric drive includes a short shaft 174 which projects into the inner race of the bearing 172 and is rigidly connected to an offset connecting rod 175 fabricated of circular steel tubing. The lower end portion of the connecting rod 175 projects into a cup-shaped cylindrical piston 180 which includes a cylindrical metal wall 182 and a circular metal bottom wall 184 welded to the wall 182. A metal plate 187 is welded to the bottom wall 184 of the piston 180, and a set of bearing blocks 189 (FIGS. 6 and 10) are secured to the plate 187 by a set of bolts 191 and receive opposite end portions of a cross pin or shaft 193. Another spherical bearing 194 has an inner race mounted on the shaft 193 and an outer race which is retained within a connection fitting 197. The fitting 197 has an upper portion 199 which is threaded into the lower portion of a coupling 202 having an upper cylindrical portion 204 projecting into the lower end portion of the connecting rod 175 and welded to the rod.

Figure 4:
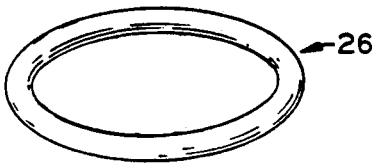
FIG. 4 is a perspective view of a resilient sealing ring shown in cross-section on the piston in FIG. 2.
Figure 6:
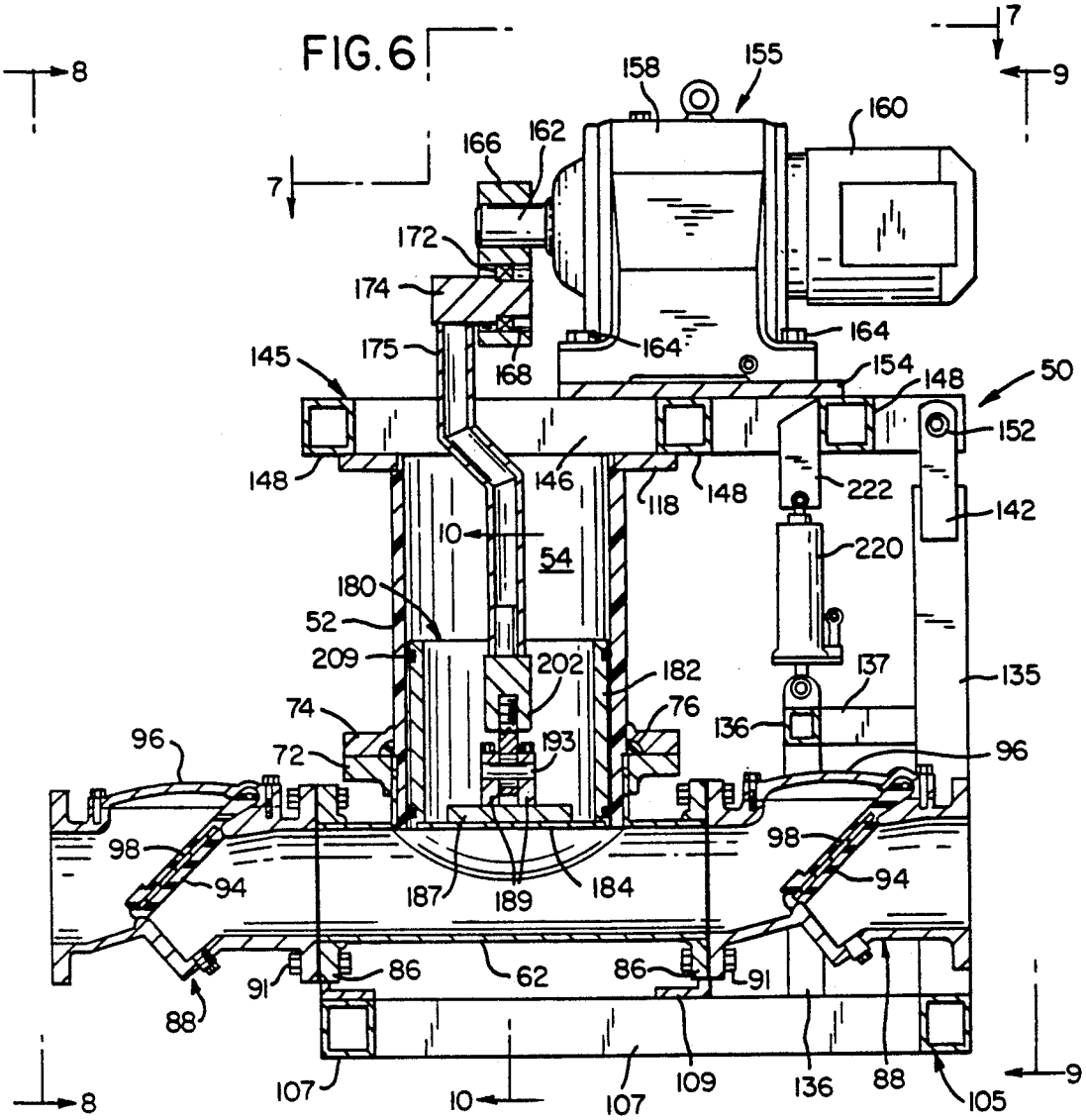
FIG. 6 is a vertical section of a modified positive displacement pump constructed in accordance with another embodiment of the invention.
Figure 7:
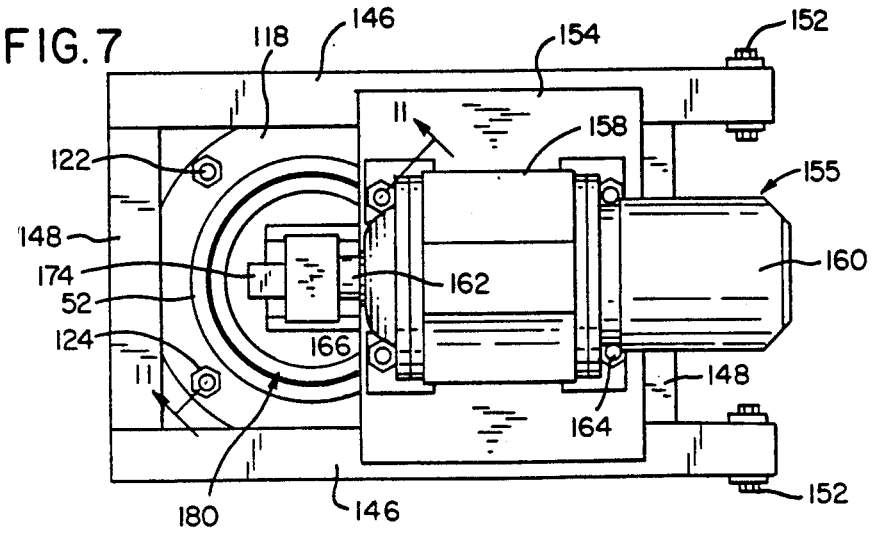
FIG. 7 is a top view of the pump, taken generally on the line 7—7 of FIG. 6.
Figure 8:
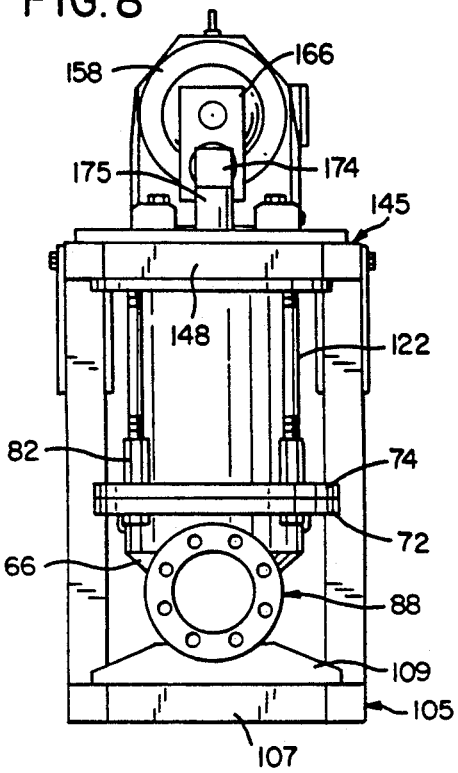
FIG. 8 is an elevational end view of the pump taken generally on the line 8—8 of FIG. 6.
Figure 10:
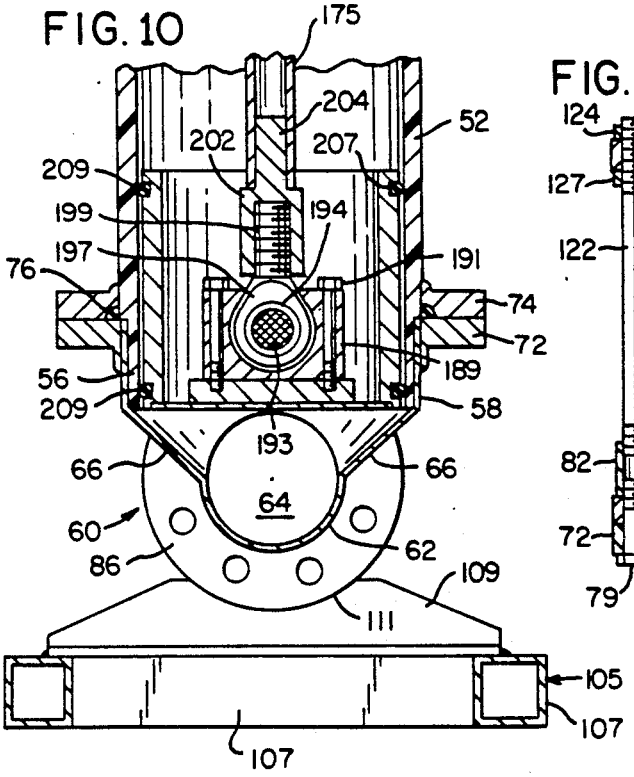
FIG. 10 is an enlarged fragmentary section taken generally on the line 10—10 of FIG. 6.
Figure 11:
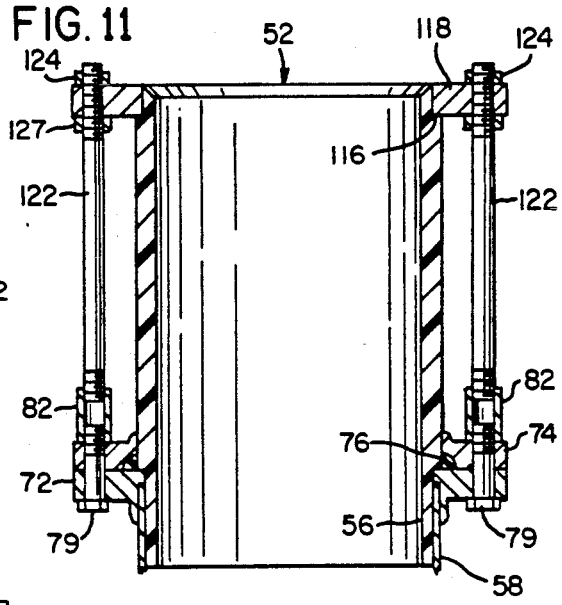
FIG. 11 is an enlarged fragmentary section taken generally on the line 11—11 of FIG. 7.

As shown in FIGS. 6 and 10, the cylindrical wall 182 of the piston 180 has upper and lower circumferential grooves 207 each of which receives a resilient ring 209 which is constructed substantially the same as the resilient ring 26 described above in reference to FIG. 4. The resilient rings 209 form sliding seals between the piston 180 and the smooth inner cylindrical surface of the pump body 52 in the same manner as described above in connection with FIG. 5.

In operation of the pump 50, rotation of the shaft 174 and reciprocating movement of the shaft 174 provide the piston 180 with a stroke of about 9 inches. The axial spacing between the resilient rings 209 is slightly greater than the piston stroke so that the sliding path of each ring 209 on the inner surface of the pump body 52 does not overlap with the sliding path of the other ring 209. This is desirable in order to minimize wear on the inner surface of the pump body 52.

As shown in FIG. 6, when the shaft 174 is in its lowermost position, the bottom wall 184 of the piston 180 is substantially flush with the top surface of the conduit 62. Thus the piston 180 does not enter the chamber 64. This prevents jamming of the piston 180 and also assures that all liquid, solids and air within the chamber 54 below the piston 180 is displaced from the chamber 54 into the conduit chamber 64. When it is desirable to replace the pump body 52 and/or the ring seals 209, which are the components subjected to the greatest wear, the bearing blocks 189 are released from the plate 187 on the bottom wall of the piston 180, and the platform 145 and drive unit 155 are tilted upwardly on the axis of the hinge bolts 152 by operation of a hydraulic jack 220 (FIG. 6) which is pivotally connected to a bracket 222 projecting downwardly from the platform 145 and the frame extension 136.

The platform 145 is pivoted through approximately 45° by the jack 220, which retracts the connecting rod 175 from the piston 180 and pump body 52. The piston 180 may then be lifted from the body 52 so that the sealing rings 209 are exposed for replacement. When the piston 180 is removed from the cylinder body 52, the inner surface of the body may be inspected for wear. If it is desired to replace the cylinder body 52, the bolts 79 and tie rods 122 are removed so that the body 52 may be pulled from the casing 58. The flange 74 and plate 118 are then removed from the pump body 52 and installed on a new pump body.

Another advantage is provided by the eccentric drive including the block 166, the eccentric shaft 174 and the offset connecting rod 175. This arrangement locates the axis of the piston 180 so that it is very close to the bearing within the gearbox 158 which rotatably supports the shaft 162 and thereby minimizes the moment arm on the shaft 162. The compression coupling including the flange 74 and the resilient sealing ring 76 also provide for forming the cylinder body 52 from extruded plastic tubing or pipe, thereby minimizing the cost for replacing the cylinder body 52 in addition to providing a corrosion resistant body. The spherical anti-friction bearings 172 and 194 also provide for a free-floating piston 180 to avoid concentrated wear on the inner surface of the cylinder body 52 and on the resilient sealing rings 209. The construction the pump base 60 further provides for conveniently constructing the pump with a different diameter conduit 62, depending on the material to be pumped and the desired flow rate through the pump.

While the forms of pump apparatus herein described constitute preferred embodiments of the invention, it is to be understood that the invention is not limited to these precise forms of apparatus, and that changes may be made therein without departing from the scope and spirit of the invention as defined in the appended claims.

The invention having thus been described, the following is claimed:

1. A positive displacement pump adapted for pumping sewage and other fluid materials containing solids, comprising a frame, a tubular pump body having a generally vertical axis and upper and lower end portions, said body further having a generally uniform wall thickness and a generally cylindrical outer surface, a pump base supported by said frame and including a conduit extending adjacent said lower end portion of said pump body, a set of check valves connected to said conduit, a motor drive unit having an output shaft, a platform connected to said frame and supporting said drive unit above said upper end portion of said pump body, a piston supported within said pump body for axial movement, a generally vertical connecting rod having upper and lower end portions, means connecting said piston to said lower end portion of said piston rod, drive means connecting said upper end portion of said connecting rod to said output shaft and to effect reciprocating movement of said piston within said pump body in response to rotation of said shaft, a first annular coupling flange surrounding said outer surface of said pump body and movable axially on said lower end portion of said pump body, a resilient sealing ring engaging said outer surface of said pump body adjacent said first coupling flange, a second annular coupling flange adjacent said first coupling flange and rigidly connected to said conduit, a support member mounted on said upper end portion of said pump body under said platform, a set of elongated generally vertical tie rods having threaded portions and positioned outwardly of said outer surface of said pump body in peripherally spaced relation, a set of threaded fasteners secured to said tie rods for rigidly connecting said first and second coupling flanges to each other for compressing said sealing ring between said flanges and against said pump body, and said tie rods extending upwardly from said second coupling flange and connected to said support member for supporting said platform and said motor drive unit and for reducing the load on said pump body.

2. A pump as defined in claim 1 wherein said pump body comprises a tubular extrusion of a rigid plastics material and having said outer surface.

3. A pump as defined in claim 1 wherein said piston defines axially spaced circumferential grooves, a resilient sealing ring confined within each said groove and engaging said pump body, and the axial spacing of said grooves is greater than the axial stroke of said piston within said pump body.

4. A pump as defined in claim 1 wherein said connecting rod has a horizontally offset upper end portion, said drive means include a drive member mounted on said output shaft and supporting a bearing, and a generally horizontal shaft secured to said upper end portion of said connecting rod and projecting into said bearing.

5. A pump as defined in claim 1 and including means for pivoting said platform and said motor drive unit to an inclined position to provide for conveniently removing said piston and said pump body after removing said fasteners and said tie rods.

6. A pump as defined in claim 5 wherein said means for pivoting said platform comprise a hydraulic jack extending between said frame and said platform.

7. A positive displacement pump adapted for pumping sewage and other fluid materials containing solids, comprising a frame, a tubular extrusion of rigid plastics material forming a pump body having a generally vertical axis and upper and lower end portions, said body further having a generally uniform wall thickness and a generally cylindrical outer surface, a pump base supported by said frame and including a conduit extending adjacent said lower end portion of said pump body, a set of check valves connected to said conduit, a motor drive unit having an output shaft, a platform pivotally connected to said frame and supporting said drive unit above said upper end portion of said pump body, a piston supported within said pump body for axial movement, a generally vertical connecting rod having upper and lower end portions, means connecting said piston to said lower end portion of said piston rod, drive means connecting said upper end portion of said connecting rod to said output shaft and to effect reciprocating movement of said piston within said pump body in response to rotation of said shaft, a first annular coupling flange surrounding said outer surface of said pump body and movable axially on said lower end portion of said pump body, a resilient sealing ring engaging said outer surface of said pump body adjacent said first coupling flange, a second annular coupling flange adjacent said first coupling flange and rigidly connected to said conduit, a support member mounted on said upper end portion of said pump body under said platform, a set of elongated generally vertical tie rods having threaded portions and positioned outwardly of said outer surface of said pump body in peripherally spaced relation, a set of threaded fasteners secured to said tie rods for rigidly connecting said first and second coupling flanges to each other for compressing said sealing ring between said flanges and against said pump body, and said tie rods extending upwardly from said second coupling flange and connected to said support member for supporting said platform and said motor drive unit and for reducing the load on said pump body.

8. A pump as defined in claim 7 and including a hydraulic jack extending between said frame and said platform for pivoting said platform and said drive unit.

* * * * *